33-241 SR
10/25/77 OR 4,055,000

United States Patent [19]
Cesin

[11] 4,055,000
[45] Oct. 25, 1977

[54] UNDERWATER SIGHT FOR A SPEAR GUN OR THE LIKE

[76] Inventor: Louie P. Cesin, 6220 SW. 20, Miami, Fla. 33155

[21] Appl. No.: 680,997

[22] Filed: Apr. 28, 1976

[51] Int. Cl.[2] ..... F41G 1/46; F41G 1/34
[52] U.S. Cl. ..... 33/241; 33/244; 362/110
[58] Field of Search ..... 33/241, 244, 245; 240/2 F, 6.41; 124/22, 27, 56

[56] References Cited

U.S. PATENT DOCUMENTS

| | | | |
|---|---|---|---|
| 982,280 | 1/1911 | Lewis | 240/6.41 |
| 1,215,171 | 2/1917 | Lewis | 33/241 |
| 1,376,357 | 4/1921 | Place | 240/6.41 |
| 2,528,080 | 10/1950 | Robertson | 33/245 |
| 3,656,845 | 4/1972 | Koch-Bossard et al. | 33/241 |
| 3,872,853 | 3/1975 | Nakatani | 33/245 |

*Primary Examiner*—Richard E. Aegerter
*Assistant Examiner*—Richard R. Stearns
*Attorney, Agent, or Firm*—Robert K. Rhea

[57] ABSTRACT

An elongated tube, adapted to be longitudinally supported by a spear gun, or the like, is provided with a transparent transverse partition at its forward end portion for preventing water entering the major portion of the tube when its forward end portion is immersed. A battery powered lamp, secured by a bracket within the water excluded end portion of the tube, illuminates a target through the transparent partition. A sight area, scored on the transparent partition, visually indicates when the gun is aligned with the target.

1 Claim, 3 Drawing Figures

UNDERWATER SIGHT FOR A SPEAR GUN OR THE LIKE

BACKGROUND OF THE INVENTION

1. Field of the Invention

The present invention relates to gun sights and more particularly to an underwater sight for aiming a spear gun, or the like.

2. Description of the Prior Art

Sights for crossbars, harpoons or spear guns have generally comprised firearm type sights including an open rear sight to be aligned with a beaded front sight, such as disclosed by U.S. Pat. No. 3,773,026, a fin to be aligned with the target as disclosed by U.S. Pat. No. 2,522,060, or a telescopic sight, such as disclosed by U.S. Pat. No. 3,224,427. These types of sights, while quite satisfactory, are not adaptable for use underwater when aiming and firing a projectile toward a target. Firing a projectile underwater is most accurately accomplished where a forward portion of the spear gun, or the like, may be immersed and aimed at the target.

This invention provides a sight which accomplishes this purpose.

SUMMARY OF THE INVENTION

The underwater sight comprises an elongated tube adapted to be longitudinally secured to the upper portion of a spear gun, or the like. The forward portion of the tube is transversely divided by a transparent partition with the forward end portion of the tube, forwardly of the partition, being open and providing with an air vent so that when the end portion of the tube forwardly of the partition and forward end portion of the gun are immersed and the forward end portion of the tube is filled with water, trapped air is released while the opposite or rearward portion of the tube, open to the atmosphere, remains dry. A battery powered light is mounted by a bracket within the dry end portion of the tube and aligned with a target indicating area scored on the surface of the transparent partition for aiming the gun.

The principal object of this invention is to provide an underwater sight for a spear gun, or the like, which substantially eliminates deflection, diffraction and reflection and in which a lamp eliminates shadows and attracts fish, or the like.

DESCRIPTION OF THE PREFERRED EMBODIMENT

Figure 1:
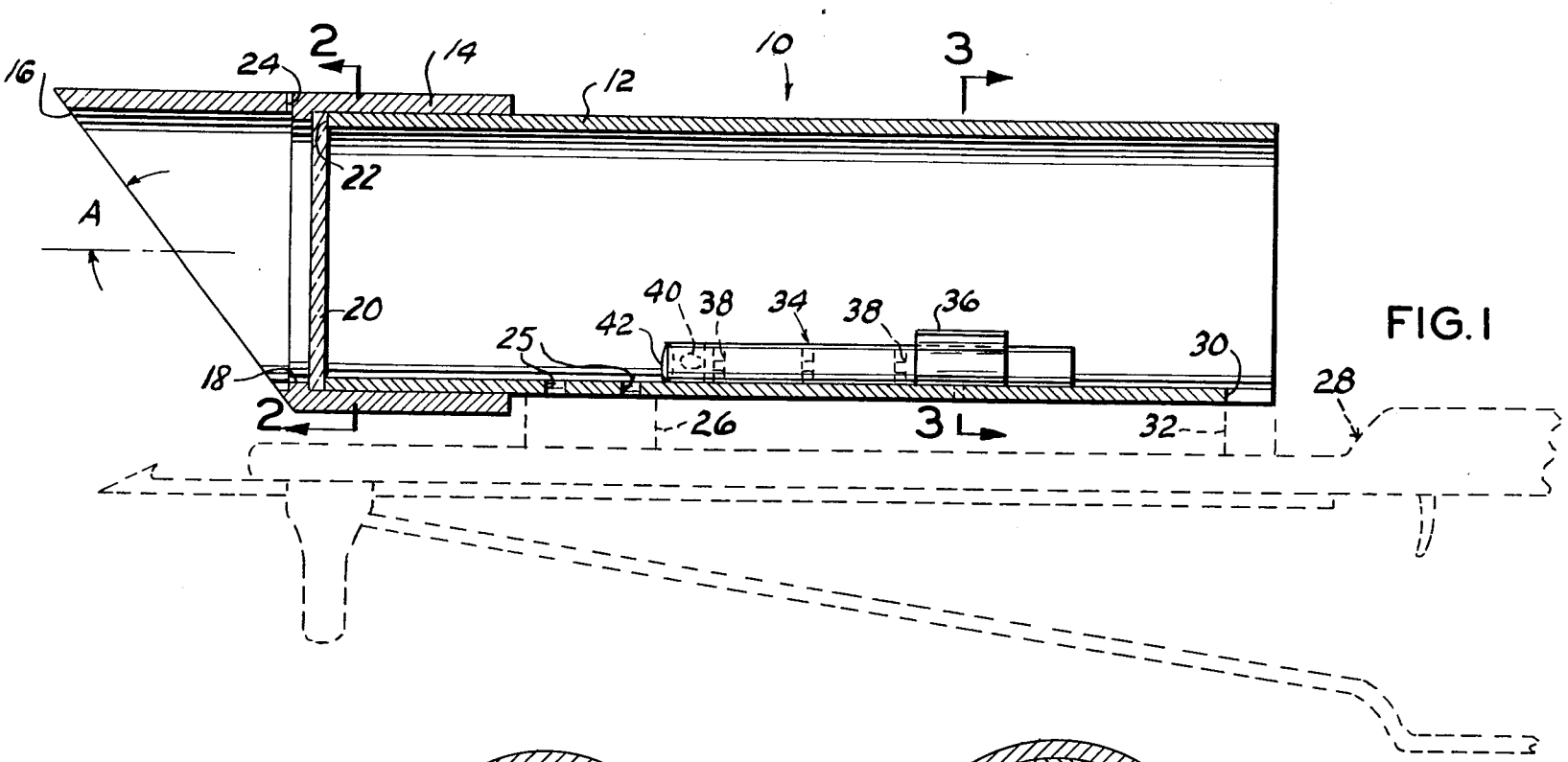
FIG. 1 is a longitudinal cross sectional view, partially in elevation, illustrating the sight when connected with a spear gun, or the like, the latter being shown by dotted lines; and, FIGS. 2 and 3 are vertical cross sectional views taken substantially along the lines 2—2 and 3—3, respectively, of FIG. 1.
Figure 2:
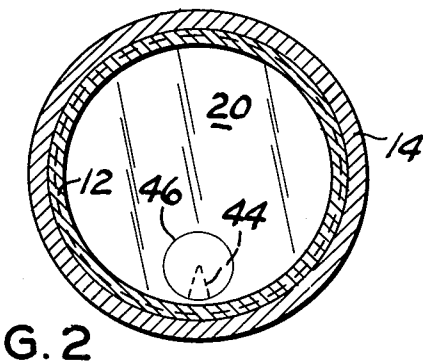
Figure 3:
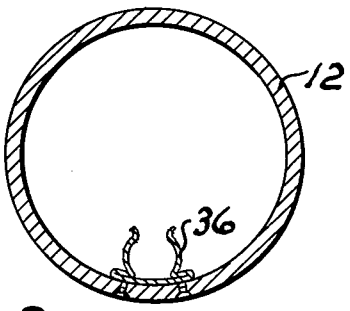

Like characters of reference designate like parts in those figures of the drawings in which they occur.

In the drawings:

The reference numeral 10 indicates the sight, as a whole, which is tubular in general configuration. The sight 10 comprises an elongated cylindrical tube 12 which is inserted at one end portion into one end portion of a sleeve 14. The other end of the sleeve 14 is provided with a beveled end surface 16. Intermediate its ends, the sleeve is provided with an inwardly projecting annular flange 18. A transparent disk forms a transverse partition 20 which is interposed between the annular flange 18 and adjacent end surface 22 of the tube 12. The sleeve 14 is provided with a bleed port 24 for releasing air trapped within the forward open end portion of the sleeve when the sight is immersed, as hereinafter explained.

Intermediate its ends, the tube 12 is provided with threaded sockets 25 for connection with a conventional bracket 26 in turn connected with a spear gun 28. The rearward end portion of the tube is provided with a slot or opening 30 similarly engaging a bracket or projection 32 mounted on or secured to the spear gun. The sight 10 is thus maintained in longitudinally aligned spaced-apart relation with respect to the spear gun.

Sight and target illuminating means 34 is mounted within the tube 12 by a bracket 36. The illuminating means 34 comprises a pen-light type flashlight including a plurality of batteries 38, a bulb or lamp 40 and a convex lens 42. The convex lens 42 is provided, on its surface, with a triangular-shaped target which is cast as a shadow by the lamp rays to the adjacent surface of the partition 20, as at 44, within a circular target area 46 scored on the surface of the partition 20.

OPERATION

In operation, the target 10 is mounted on the spear gun 28 and the forward end portion of the target and spear gun is disposed below the surface of a body of water, not shown. The tube end surface 16 is preferably disposed at an acute angle A (FIG. 1) with respect to the longitudinal axis of the tube so that the end surface 16 is immediately immersed when the sight and gun 28 is initially immersed when seeking and aiming the gun at a target. This action prevents above water light rays from striking the forward surface of the partition 20. Air bubbles trapped within the forward end portion of the coupling 14 are released through the bleed port 24 while the other end portion of the tube 12, projecting out of the water, remains dry, the spear gun is visually aimed at a selected target illuminated by the light means 34.

Obviously the invention is susceptible to changes of alterations without defeating its practicability. Therefore, I do not wish to be confined to the preferred embodiment shown in the drawings and described herein.

I claim:

1. An underwater sight for a spear gun, or the like, comprising:

an elongated tube having forward and rearward open ends and having means including sockets in its wall for connection with a spear gun;

a transparent wall transversely dividing said tube adjacent one end portion for excluding water from the other end portion of said tube when said one end portion is immersed, the end surface of the immersed end of said tube being inclined at an acute angle with respect to the longitudinal axis of the tube, said tube having a bleed hole in its walls adjacent and in front of said partition; and, lamp means contained by said other end portion of said tube for illuminating a submersed target.

* * * * *